United States Patent [19]

Hill

[11] Patent Number: 5,027,411

[45] Date of Patent: Jun. 25, 1991

[54] HIGH FREQUENCY LOUDSPEAKER

[75] Inventor: Amel L. Hill, Cassel Berry, Fla.

[73] Assignee: Clyde W. Pierce, DeLand, Fla.

[21] Appl. No.: 294,366

[22] Filed: Jan. 6, 1989

[51] Int. Cl.[5] ..... H04R 25/00

[52] U.S. Cl. ..... 381/160; 181/165; 181/187

[58] Field of Search ..... 381/158, 160, 153, 159, 381/161; 181/166, 191, 187, 192, 195, 164, 165, 157, 158, 171, 172

[56] References Cited

U.S. PATENT DOCUMENTS 2,541,946 2/1951 Stark ..... 181/187
4,029,910 6/1977 Allison ..... 381/199

OTHER PUBLICATIONS

Abraham B. Cohen, "Wide-Angle Dispersion of High--Frequency Sound", Dec. 1952.

*Primary Examiner*—Forester W. Isen
*Assistant Examiner*—M. N. McGeary, III
*Attorney, Agent, or Firm*—Banner, Birch, McKie & Beckett

[57] ABSTRACT

An improved loudspeaker assembly for frequencies higher than approximately 6 kHz, i.e., a tweeter assembly, is disclosed. The tweeter assembly includes a dome tweeter driver for delivering high frequency sound to a listener, and a cylindrical housing for mounting the tweeter driver in a horizontal plane. A centrally located aperture is provided in the top surface of the housing for receiving the dome portion of the tweeter, and a plurality of concentric annular ridges are also provided, and are spaced outwardly from the tweeter dome. The annular ridges function to reflect sound energy transmitted off the dome structure, and are used to disperse the high frequency energy in a horizontal direction within the listening room.

10 Claims, 2 Drawing Sheets

HIGH FREQUENCY LOUDSPEAKER

This application is related by subject matter to commonly assigned copending application Ser. Nos. 07/294,364, 07/294,365, and 07/294,446 filed concurrently herewith.

TECHNICAL FIELD

This invention relates to an improved loudspeaker assembly for frequencies higher than approximately 6 kHz.

BACKGROUND OF THE INVENTION

The basic theory of sound transmission is set forth, for example, in standard introductory physics textbooks such as Resnick and Halliday, *Physics*, Part I, John Wiley & Sons, 1977, pp. 433–456. As described therein, sound is a longitudinal mechanical wave having a frequency within a range of approximately 20 Hz to 20 KHz. Typically, sound is generated by vibrating elements which alternately compress the surrounding air on a forward movement and rarefy it on a backward movement. Air transmits these disturbances outward from the source as a longitudinal wave. Upon entering the ear, these waves produce the sensation of sound.

In the art of sound reproduction, a loudspeaker is generally understood to be a device which converts electrical energy into sound energy. Multiple loudspeakers are often used in sound reproduction applications requiring high acoustic power output, and it is also common to provide different devices for reproducing the bass (low-frequency), midrange and high-frequency portions of the sound spectrum. A tweeter is generally responsive only to the higher acoustic frequencies, i.e., frequencies higher than approximately 6 kHz, and reproduces sound of high pitch.

The primary components of a loudspeaker are an electromagnet and a vibrating diaphragm attached to an armature that is vibrated by the variations of electric current in the electromagnet. A cone speaker is a particular type of loudspeaker in which the vibrating diaphragm is relatively large and conical and usually made of paper. A simple cone speaker assembly includes a speaker housing or cabinet, a transducer, and a speaker cone. The transducer causes the speaker cone to vibrate in response to signals from an amplifier, thus producing sound in the manner described above. The vibration of the speaker cone generates two longitudinal sound waves, a front wave and a back wave, which, at least initially, propogate in opposite directions. It is generally the front wave which generates the sounds, such as music, heard by a listener.

In previous sound reproduction systems, the sounds heard by a listener have often been directional in nature and have depended upon the relative positioning of the loudspeaker and the listener. Thus, the loudspeakers in a room must be carefully arranged by a listener to properly direct the sound for maximum acoustic quality. However, even a careful arrangement of speakers within a room is often unsatisfactory since it is unlikely that all of the listeners in a particular room will be positioned so as to be in a region of maximum acoustic quality. This problem of directionality has been particularly bothersome in systems incorporating domed or hemispherical-type tweeters, which are highly directional and which normally tend to project a strong front wave of sound energy in an axial direction.

In some sound reproduction systems, the vibration of the loudspeaker diaphragm also generates subordinate vibrations such as cabinet vibrations, which contribute to low quality sound reproduction. This is particularly true of cabinets formed of acoustically active materials, such as wood, which are relatively sensitive to vibratory forces. These subordinate vibrations modify or "cloud" the sound generated by the excitation of the diaphragm. This effect is known as intermodulation (IM) distortion, and is an important factor to be addressed in speaker design.

Because loudspeakers are designed to reproduce sound as faithfully as possible, the design must be compatible with the physics of sound, particularly if it is desired to reproduce high fidelity musical sound. Musical waveforms have a sinusoidal basis. Since sine waves are algebraic, a sound reproduction device should be curvilinear, rather than rectilinear, in design. An example of such design is the "bell-type" shape of many musical instruments.

All musical sound waves travelling in a medium (such as air, water, etc.) are acoustical (or physical). The sound waves are also algebraic functions since the fundamental frequency is sinusoidal (as on the lowest notes from the flute). All harmonics, or overtones, are also sinusoidal. Since the function of a loudspeaker is to receive the electronic format of the sound and reproduce the sound as acoustical (or physical) wave action in the medium through which it travels, it follows that the shapes involved in the loudspeaker baffle, resonating and transferral devices should be compatible with this sinusoidal nature. Therefore, the most compatible shapes should be curves, spheres, triangles or pyramids, rather than straight lines, cubes, squares or rectangles. The compatible sinusoidal shapes greatly enhance the sinusoidal characteristics of each fundamental frequency and its complement of harmonics, or overtones. This also applies to "ports" which transfer acoustical sound pressure waves within the speaker assembly, and also to the transfer of the waves to the surrounding transmitting medium.

SUMMARY OF THE INVENTION

It is an object of the present invention to provide a speaker in which the acoustic quality is independent of a listener's location relative to the speaker. In particular, it is an object of this invention to provide a high frequency speaker capable of transmitting high frequency sound waves at substantially the same energy level in both a 180° vertical plane and across a 360° horizontal plane.

It is another object of the present invention to provide a speaker which is relatively small in size so that it does not intrude upon the interior design of a listening room or with the layout, for example, of furniture within the listening area.

Yet another object of this invention is to provide a speaker which can be easily manufactured without substantial costs.

A tweeter assembly in accordance with the present invention comprises a domed or hemispherical tweeter driver and a cylindrical housing for mounting the tweeter driver in a horizontal plane. A centrally located aperture is provided in the top surface of the housing for receiving the dome portion of the tweeter driver, and a plurality of concentric annular ridges are also provided which are spaced outwardly from the center dome portion of the tweeter driver. The annular ridges function to reflect sound energy transmitted off the domed tweeter driver, and are used to disperse the high frequency energy in a horizontal direction within the listening room. The tweeter assembly, thus, creates an omnidirectional effect in which high frequency energy is directed along a wide horizontal plane to members of a listening audience who may be at various locations throughout the listening room. Because of this omnidirectional characteristic, speaker placement becomes less critical so that the speakers may be more easily positioned without affecting acoustic quality.

BRIEF DESCRIPTION OF THE DRAWINGS

A more complete understanding of the invention can be had by reference to the following detailed description taken in conjunction with the accompanying drawings in which.

DETAILED DESCRIPTION OF THE PREFERRED EMBODIMENT

Figure 1:
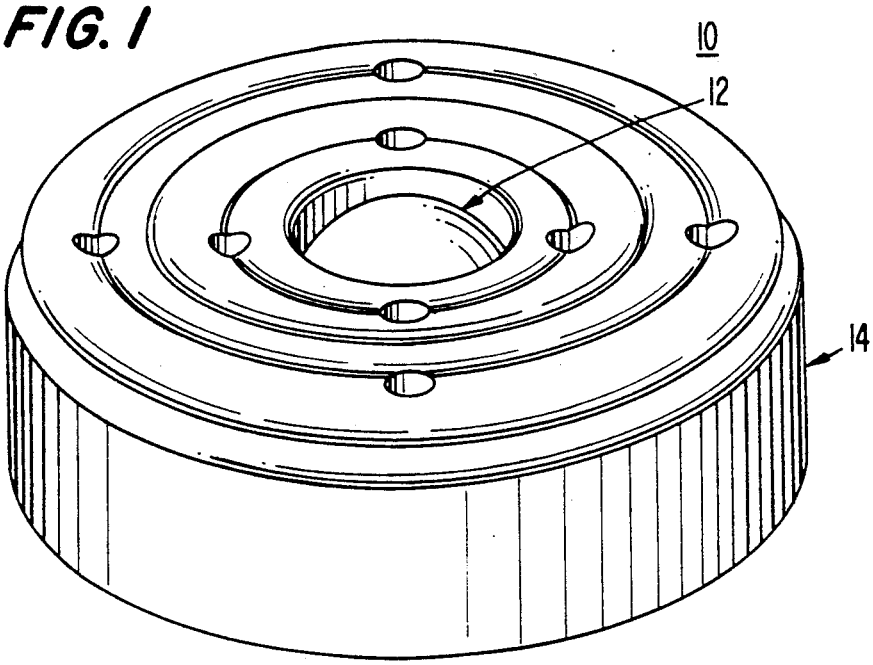
FIG. 1 is a perspective view of the tweeter assembly of the present invention.

FIGS. 1 through 5 show a tweeter assembly in accordance with the preferred embodiment of the present invention. The loudspeaker of this embodiment is intended to operate over a frequency range of approximately 6 kHz to 20 kHz. However, it will be apparent to those skilled in the art that this invention may be used to construct a loudspeaker which operates over a wider or narrower frequency range.

As shown in the figures, tweeter assembly 10 comprises a tweeter driver 12 for transmitting high frequency sound to a listening audience, and a cylindrical housing 14 for mounting driver 12 in a horizontal plane.

Tweeter driver 12 is a dome-type tweeter having a dome or hemispherical shaped diaphragm of reasonable quality, and is preferably designed so that the peak of the dome extends above the surface of the housing. For example, in the preferred embodiment, the dome extends approximately 0.188 inches above the housing surface. The tweeter driver also preferably has a frequency response in the 6 kHz–20 kHz band, and additionally has a particularly smooth frequency response curve in the high-frequency band from about 10 kHz to 20 kHz. As will be explained, in the present tweeter assembly, some frequencies will be attenuated with the greatest amount of attenuation occurring at the higher frequencies, i.e., between 10 kHz and 20 kHz. For this reason, it becomes particularly important that a tweeter driver be selected which has a strong response in the 10 kHz–20 kHz range, which will counterbalance the attenuation and, thus, ensure a flat frequency response over as wide a frequency range as possible (preferably 6 kHz–17.5 kHz) for the tweeter assembly as a whole.

One tweeter driver that has been found satisfactory is the Audax tweeter Model DTW100T125 which is a one-inch titanium dome tweeter. This tweeter has a resonant peak at 10 kHz and exhibits a substantially flat frequency response in the range from 10 kHz to 20 kHz, with the response curve dropping off smoothly from there to about 30 kHz. The tweeter also has a boosted response of about 1 to 2 dB over the 10 kHz to 20 kHz range as compared to the 6 kHz to 10 kHz range.

Figure 2:
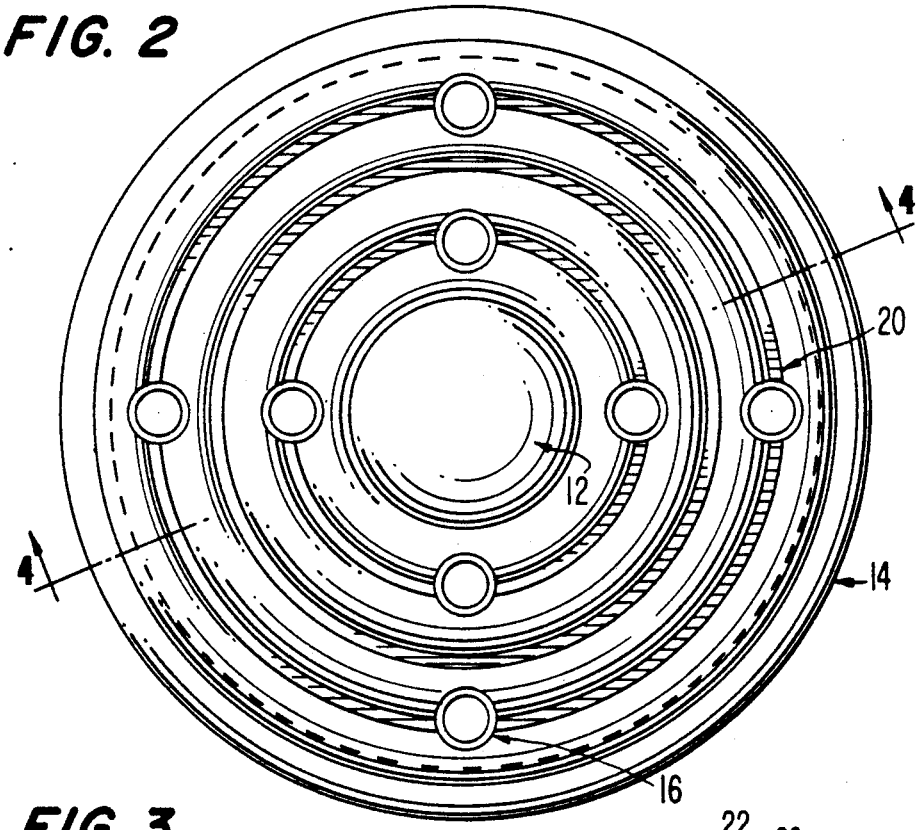
FIG. 2 is a top view of the assembly shown in FIG. 1.
Figure 3:
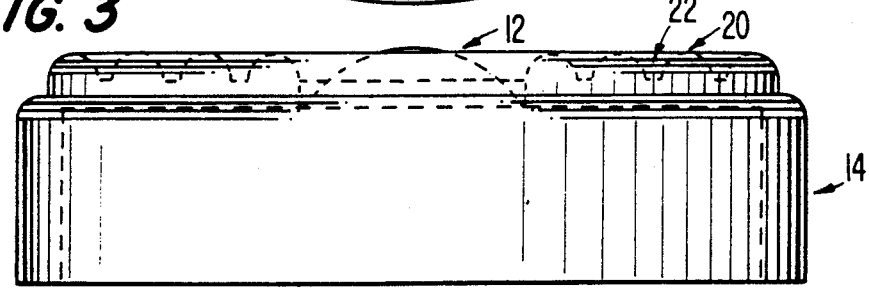
FIG. 3 is a side view of the tweeter assembly of FIG. 1.

Housing 14 is provided for mounting the tweeter driver and, as best seen in FIGS. 1 and 2, includes a centrally located aperture located in the top surface of the housing for receiving the dome portion of the tweeter driver. The tweeter driver is then further secured to the housing by a plurality of spaced bolts or screws 16 which extend through the housing and are coupled to the supporting plate of the driver. (See FIG. 2)

A plurality of concentric annular ridges 20 are also provided on the surface of housing 14, and are spaced outwardly from the center dome of tweeter driver 12. Annular ridges 20 project upwardly as hemispherical mounds, and are used to reflect high-frequency energy transmitted from the driver out to the listening room, as will be explained.

Housing 14 is constructed of a low resonance material to minimize sound distortion or coloration which may be produced by undesirable vibration of the housing structure, and is preferably formed of an ABS® foam plastic, which is a sonically dead, dense material that is acoustically inert. ABS® is a registered trademark of the DuPont Corporation.

While the present invention contemplates that the speaker components may be formed from a wide range of materials, acoustically inert materials have been found to enhance acoustic quality. Thus, in the preferred embodiment, housing 14 is constructed of ABS® foam plastic produced by GE Plastics of Parkersburg, W. Va. ABS® foam has superior acoustic characteristics and exhibits no resonance. Use of the ABS® foam, thus, minimizes intermodulation distortion.

Figure 4:
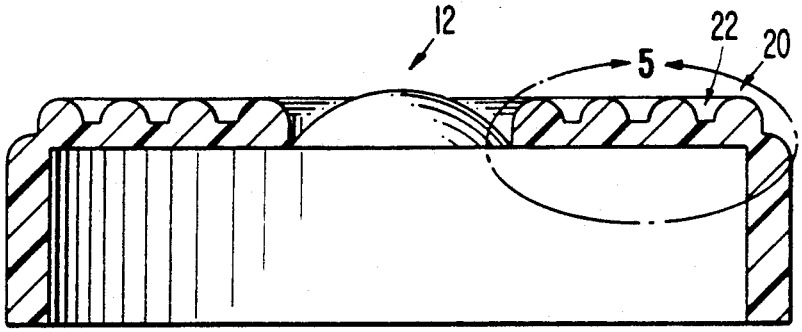
FIG. 4 is a cross-sectional view of the tweeter assembly taken along line 4—4 of FIG. 2.
Figure 5:
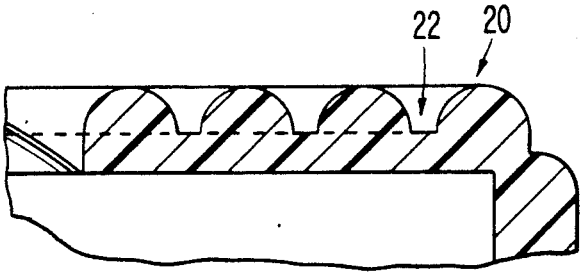
FIG. 5 is an enlarged partial cross-sectional view of the tweeter assembly of FIG. 4.

As best seen in FIGS. 4 and 5, in the preferred embodiment, housing 14 has four (4) concentric annular ridges 20 having semicircular cross-section which surround the center dome of tweeter driver 12. Annular ridges 20 are displaced at a distance from the driver dome, and adjacent ridges 20 are also separated from each other by grooves 22.

The width of grooves 22 and the radius of annular ridges 20 are critical dimensions and are determined as a function of the respective wavelengths of the upper and lower limits of the frequency range intended to be propogated by the speaker. More specifically, in the case of the grooves, the groove width is at least equal to the quarter wavelength of the lower frequency limit which takes into account that the wave reaching the groove will have been reflected twice and consequently will have a wavelength of no more than $\frac{1}{4}$ of the length of the direct wave. The effect of this arrangement is that the groove acts as a frequency attenuator, with the extent of attenuation increasing with increases in the broadcast frequencies. In other words, within the space defined by the grooves, a ping-pong effect occurs in that the sound waves interact in a phase cancelling relationship thereby attenuating the sound waves. As frequencies increase, the ping-pong effect increases, thereby increasing the attenuation. Accordingly, it is desired to design the width of the groove to attenuate higher frequencies.

The tweeter of the preferred embodiment is intended to propogate frequencies in approximately the 6 kHz to 17.5 kHz range. At 6 kHz, the quarter wavelength is approximately 0.047 inches and the quarter wavelength at 17.5 kHz is approximately 0.016 inches. By selecting a groove width greater than 0.047, one is assured that some attenuation will occur in the grooves over the entire frequency range with increased attenuation occurring with increasing frequencies. Because the tweeter driver of the preferred embodiment, as explained above, is characterized by a 1 to 2dB gain in the 10 kHz to 20 kHz frequency range, the grooves provide a net effect of a smooth frequency response for the tweeter assembly as a whole.

In tests of the present embodiment using a TES System 10 computer to create a time delay spectrometry (TDS) curve, it was determined that the preferred range of widths is from 0.0485 to 0.108 inches, with the smoothest response being achieved with a groove width of 0.075 inches. Use of this width was found to produce the least amount of comb filtering and to minimize peaks in the TDS curve.

Substantially similar considerations were used in determining the proper radius for ridges 20. The ridges, as shown in the figures, are exposed surfaces and will receive the first incident of reflection, which will have a wavelength of not more than ½ of the wavelength of the direct wave. The critical measurements in the 6 kHz to 17.5 kHz frequency range were, therefore, those relating to half wavelengths, or approximately 0.094 inches for 6 kHz and 0.032 inches for 17.5 kHz. The radius of the ridge is then chosen so that it equals at least the half wavelength of the lower frequency limit, i.e., 6 kHz.

Again using the TES System 10 computer, an energy frequency time curve (EFTC) was developed from which a preferred radius range was determined. This range, from 0.094 inches, to 0.21 inches, was determined to minimize the number of peaks of the EFTC curve over the 180° arc measured, with the optimal conditions occurring at 0.1535 inches where the curve exhibited the minimum number of peaks.

Normally, a dome or hemispherical-type tweeter is highly directional, and will direct sound energy upwardly in an axial direction. The present invention is designed to diffuse the sound waves, which are propagated off the surface of the dome, in a horizontal direction, i.e., along a line perpendicular to the central vertical axis of the tweeter, so that the width of the sound image is made acoustically larger than the image height. Ridges 20 are, thus, configured to create a cascading waterfall effect in which the wave pattern is redirected in the horizontal plane. This, in turn, ensures that the tweeter is made more omnidirectional so that an enlarged area of balanced listening is created. Because of this omnidirectional characteristic, speaker placement is made less critical so that the speakers may be easily positioned without affecting acoustic quality. The tweeter assembly may, thus, be set practically anywhere in a listening room, but is best located at the center of the room mounted flush in the ceiling. The depicted assembly is modified for mounting in a ceiling by replacing the cylindrical support with an annular ring mounting flange.

In operation, sound waves transmitted from the tweeter driver are propagated off the dome of the tweeter in an approximately 180° vertical plane. The sound waves are then reflected upwardly and outwardly by housing 14, which acts as an acoustic amplifier, as well as a first order filter. To explain further, as sound waves are propagated off the tweeter dome, the high-frequency energy is reflected off the reflective arc surfaces of ridges 20, with energy being reflected vertically off the arc portions of the ridges on the side nearest the tweeter, and energy being diffused horizontally off the arc portions on the opposite side near the outside of the speaker. The sound is, thus, reflected in an approximate 180° vertical plane around the tweeter center and in a 360° horizontal plane so that full sound is received throughout the listening area.

As waves travel along the surfaces of the annular ridges in a horizontal direction, some waves will be trapped in the grooves 22 between adjacent ridges 20. These waves are then reflected against other transmitted waves of like frequency. When a direct wave intermingles with a reflected wave, the direct wave will be out of phase, and a phase cancellation will occur. This then allows for a smooth frequency response in the 360° horizontal plane and the 180° vertical plane about the tweeter center.

The ridge and intervening groove construction also results in an acceleration of the waves in a horizontal direction. This acceleration results from the summing of the waves reflected off the surface portions of ridges 20 in the horizontal direction which causes the horizontal energy reflected from the ridges to exhibit a higher amplitude than the vertical energy transmitted off the tweeter dome.

Figure 6:
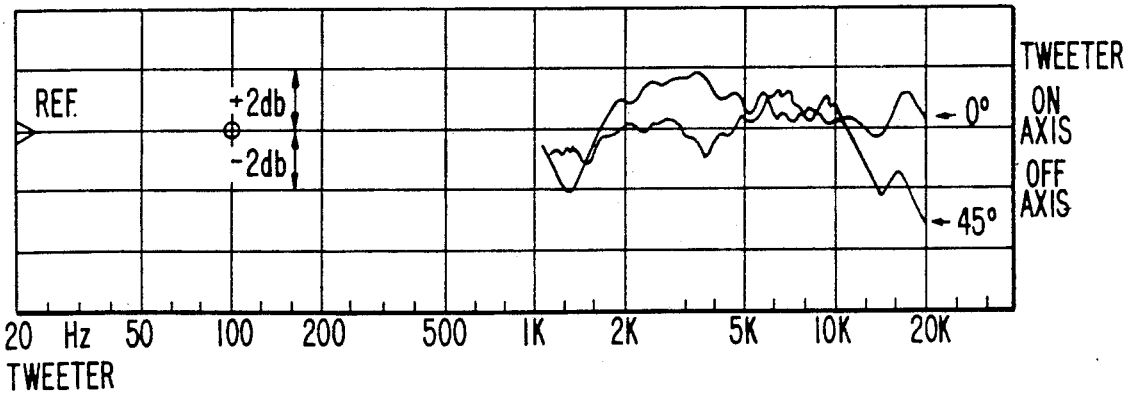
FIG. 6 is a graph showing the frequency response of the tweeter assembly.

When a model of the above-described embodiment was tested, the tweeter assembly exhibited a frequency response which is graphically represented in FIG. 6. In the figure, the curve labeled "0° on axis" was developed with a microphone located along the central vertical axis of the tweeter driver, and the curve labeled "45° off axis" was developed with the microphone positioned at an angle of 45° relative to the central axis. In both curves, the signal is elevated at frequencies from about 6 kHz to 17 kHz, which substantially corresponds to the useful frequency range for audible sound systems. The signal then tapers off from there to zero at about 20 kHz. The device, thus, exhibits a substantially flat response in the 6 kHz to 17 kHz range, with the grooves acting as a frequency attenuator for frequencies above 20 kHz.

Although the preferred embodiment has been described in detail, it should be understood that various changes, substitutions and alterations can be made therein without departing from the spirit and scope of the invention as defined by the appended claims. Thus, for example, though grooves 22 are illustrated as substantially flat, planar surfaces, the grooves may alternatively be v-shaped or semicircular in configuration. Similarly, the number of annular ridges can also be adjusted to accommodate the physical space constraints of the speaker system, and housing 14 may be a flat plate having annular ridges and grooves, as described above, formed on the surface of the plate.

I claim:

1. A tweeter assembly comprising:

a dome tweeter driver for transmitting high frequency sound to a listening audience; and a housing for centrally mounting said tweeter driver; said housing comprising at least one annular ridge, spaced outwardly from the dome of the tweeter driver, and having a curvilinear surface shaped to diffuse sound energy transmitted from said tweeter driver in a horizontal direction.

2. The tweeter assembly of claim 1 wherein the dome of said tweeter driver is disposed at a predetermined distance away from said annular ridge, which distance is at least equal to the quarter wavelength of the lower frequency limit of the sound energy intended to be propogated by said tweeter assembly.

3. The tweeter assembly of claim 1 wherein said housing comprises at least two annular ridges arranged in a concentric pattern.

4. The tweeter assembly of claim 3 wherein the annular ridges are separated by a groove, the width of said groove being at least equal to the quarter wavelength of the lower frequency limit of the sound energy intended to be propogated by said tweeter assembly.

5. The tweeter assembly of claim 1 wherein the radius of said annular ridge is at least equal to the half wavelength of the lower frequency limit of the sound energy intended to be propogated by said tweeter assembly.

6. The tweeter assembly of claim 5 wherein the radius of said annular ridge is in the range from 0.094 inches to 0.21 inches.

7. The tweeter assembly of claim 6 wherein the radius of said annular ridge is 0.1535 inches.

8. The tweeter assembly of claim 4 wherein the width of the groove between the annular ridges is in the range from 0.0485 inches to 0.108 inches.

9. The tweeter assembly of claim 8 wherein the width of the groove between the annular ridges is 0.075 inches.

10. The tweeter assembly of claim 1 wherein said tweeter driver is of a titanium dome design.

* * * * *